US006398440B1

(12) United States Patent
Hills

(10) Patent No.: US 6,398,440 B1
(45) Date of Patent: Jun. 4, 2002

(54) APPARATUS FOR FORMING A GUIDE COAT AND REPLACEMENT PARTS THEREOF

(75) Inventor: Robin William Hills, High Wycombe (GB)

(73) Assignee: Speedarrive Projects Ltd. (GB)

( * ) Notice: Subject to any disclaimer, the term of this patent is extended or adjusted under 35 U.S.C. 154(b) by 0 days.

(21) Appl. No.: 09/494,573

(22) Filed: Jan. 31, 2000

Related U.S. Application Data

(63) Continuation of application No. 08/930,524, filed as application No. PCT/GB96/00766 on Mar. 29, 1996, now abandoned.

(30) Foreign Application Priority Data

Mar. 30, 1995 (GB) ..... 9506529

(51) Int. Cl.[7] ..... B05C 1/00; B05C 17/10; B05D 1/12

(52) U.S. Cl. ..... 401/130; 401/123; 401/139

(58) Field of Search ..... 401/123–127, 401/130, 136, 139, 118, 119

(56) References Cited

U.S. PATENT DOCUMENTS

| | | | | | |
|---|---|---|---|---|---|
| 1,028,618 | A | * | 6/1912 | Smith | 401/130 |
| 1,450,386 | A | * | 4/1923 | Regan | 401/130 |
| 1,534,259 | A | | 4/1925 | Dempsey | |
| 1,573,036 | A | * | 2/1926 | Bowman | 401/130 |
| 1,580,690 | A | * | 4/1926 | Sierad et al. | 401/130 |
| 1,641,765 | A | * | 9/1927 | Krank | 401/130 |
| 1,818,340 | A | * | 8/1931 | Lemoine | 401/130 |
| 2,317,662 | A | | 4/1943 | Zimmerman | |
| 2,365,921 | A | | 12/1944 | Vaughn | |
| 2,400,926 | A | | 5/1946 | Harding | |
| 2,919,703 | A | | 1/1960 | Pinteau | |
| 3,047,199 | A | * | 7/1962 | McBain | 401/123 |
| 3,682,558 | A | | 8/1972 | Miller | |
| 3,729,011 | A | | 4/1973 | Gleicher | |
| 3,871,390 | A | * | 3/1975 | Spatz | 401/130 |
| 3,953,643 | A | | 4/1976 | Cheung et al. | |
| 3,953,644 | A | * | 4/1976 | Camelon et al. | |
| 4,176,205 | A | | 11/1979 | Molina | |
| 4,226,740 | A | | 10/1980 | Worsham et al. | |
| 4,269,527 | A | | 5/1981 | Lipfert et al. | |
| 4,356,941 | A | | 11/1982 | McRoskey et al. | |
| 4,393,112 | A | | 7/1983 | Honjo et al. | |
| 4,402,983 | A | | 9/1983 | Craven | |
| 4,728,210 | A | | 3/1988 | Barish et al. | |
| 4,740,566 | A | * | 4/1988 | Tremper, III | |
| 4,752,147 | A | | 6/1988 | Persi | |
| 5,148,951 | A | | 9/1992 | Moure et al. | |
| 5,188,472 | A | * | 2/1993 | Sgro | 401/124 |
| 5,710,214 | A | * | 1/1998 | Chou et al. | 525/124 |
| 5,721,011 | A | * | 2/1998 | Bastow | 427/201 |
| 5,853,467 | A | * | 12/1998 | Ostlie | 106/31.28 |
| 6,068,880 | A | * | 5/2000 | Hills | 427/198 |
| 6,083,316 | A | * | 7/2000 | Bastow | 106/419 |

FOREIGN PATENT DOCUMENTS

| | | | |
|---|---|---|---|
| FR | 1101727 | 4/1955 | 401/123 |
| WO | 9508405 | 3/1995 | |
| WO | 9530493 | 11/1995 | |

* cited by examiner

*Primary Examiner*—Charles R. Eloshway
(74) *Attorney, Agent, or Firm*—Webb Ziesenheim Logsdon Orkin & Hanson, P.C.

(57) ABSTRACT

The apparatus has a first container part within which material for distributing over a surface as a guide coat is held in a substantially loose, finely divided particulate form; a perforated element through which the particulate material can be sprinkled or shaken; and a second container part for receiving an applicator, e.g., in the form of a sponge, on which the particulate material is to be sprinkled or shaken. The apparatus may be provided with the applicator or as a replacement part or "re-fill" for existing apparatus. Particulate material may also be provided for re-charging such apparatus.

4 Claims, 2 Drawing Sheets

APPARATUS FOR FORMING A GUIDE COAT AND REPLACEMENT PARTS THEREOF

CROSS REFERENCE TO RELATED APPLICATION

This application is a continuation of U.S. application Ser. No. 08/930,524 filed Sep. 29, 1997 now abandoned, which is the national phase of International Application PCT/GB96/00766 filed Mar. 29, 1996, designating inter alia the United States, which United States and International applications are herein incorporated by reference.

BACKGROUND OF THE INVENTION

1. Field of the Invention

This invention relates to apparatus for forming a guide coat on a surface, e.g. the surface of a vehicle body which is being repaired and refinished, and to replacement parts thereof, e.g. re-fills for such apparatus.

2. Description of the Prior Art

When a surface such as that of a vehicle body is being refinished, particularly after repair of accident damage, it is common practice to apply body fillers and stoppers (a very fine filler) and a series of layers of primers, stone chip or corrosion protection coatings, paint coats and sealants etc. which are each rubbed down before application of the next coat in order to obtain a smooth surface and to a in re-working of top paint coats and lacquers. Filling materials are used to repair indentations, scratches etc. and these are prepared by sanding, filing and other abrasive techniques to achieve a smooth surface. This may be done using power assisted equipment or by hand. A range of abrasive materials may be used such as sand papers, production papers, wet and dry abrasive papers and sanding pads. Coarse abrasives are initially used then finer and finer abrasives until the desired finish is achieved.

To assist in this process it is known to apply a guide coat to the surface being re-finished. The guide coat is an intermediate coat applied to one of the re-finishing coats to provide a visual guide to the progress of such smoothing operations. As the surface of a coating of, say, primer is eroded by sanding, the guide coat is removed from the high spots of that coating whereas the guide coat remains on low spots or other indentations. The operator may continue the abrading process to smooth out these irregularities and thus remove the guide coat or it may prove necessary to correct surface irregularities revealed by further filling or re-working the surface (e.g. by panel beating) before the sanding process is continued. The guide coat thus helps the operator to achieve a smooth finish by visually enhancing any irregularities remaining in the surface during sanding and by indicating the areas which have not yet been sanded. Such a guide coat may be used at each stage of the process, i.e. for each coating which requires rubbing down, or as required by the operator. A guide coat may also be applied to highlight particular surface irregularities or blemishes such as scratches, pin holes, "orange peel" or dry-spray edges.

The guide coat is conventionally formed by a dilute mixture of paint and thinners, e.g. 1 part paint to 10 parts thinners, sprayed over the surface being finished. However, this suffers from the disadvantages that surrounding areas need to be masked, as the thinners based coating may stain or otherwise damage good paintwork, and as the tinners is usually a volatile petrochemical, such as a cellulose solvent, the operator should wear a mask and fume extraction is required for the area in which the work is carried out. With increasing legislation designed to protect the environment, severe restrictions are likely to be imposed on such fume extraction and the use of such solvent based guide coats may no longer be permitted. In addition, there are the usual problems associated with the storage of such flammable liquids.

U.S. Pat. No. 4,752,147 discloses a fluid applicator system comprising a fluid containing jar, an applicator sponge attached to a lid and a perforated plate at an adjustable position within the jar for compressing the sponge and thus regulating the amount of fluid it can absorb. This prior art does not, however, relate to the formation of a guide coat of finely divided particulate material.

This invention aims to provide apparatus for forming a guide coat without the need to use such petrochemical solvents and so avoids the disadvantages of these materials.

SUMMARY OF THE INVENTION

According to a first aspect of the invention, there is provided guide coat forming apparatus comprising a first container part within which material for distributing over a surface as a guide coat is held in a substantially loose, finely divided particulate form; perforated means through which the particulate material can be sprinkled or shaken; and a second container part for receiving applicator means on which the particulate material is to be sprinkled or shaken.

According to a second aspect of the invention, there is provided guide coat forming apparatus comprising: a container within which material for distributing over a surface as a guide coat is held in a substantially loose, finely divided particulate form, and perforated means through which the particulate material can be sprinkled or shaken being mounted at the mouth of the said container.

According to further aspects of the invention there is provided a first container part housing said material when supplied for use as a replacement part of guide coat forming apparatus and material for distributing over a surface as a guide coat when supplied for use in recharging guide coat forming apparatus.

Other features of the invention will become apparent from the following description and from the subsidiary claims of the specification.

BRIEF DESCRIPTION OF DRAWINGS

The invention will now be further described, merely by way of example, with reference to the accompanying drawings in which.

DESCRIPTION OF THE PREFERRED EMBODIMENTS

Figure 1:
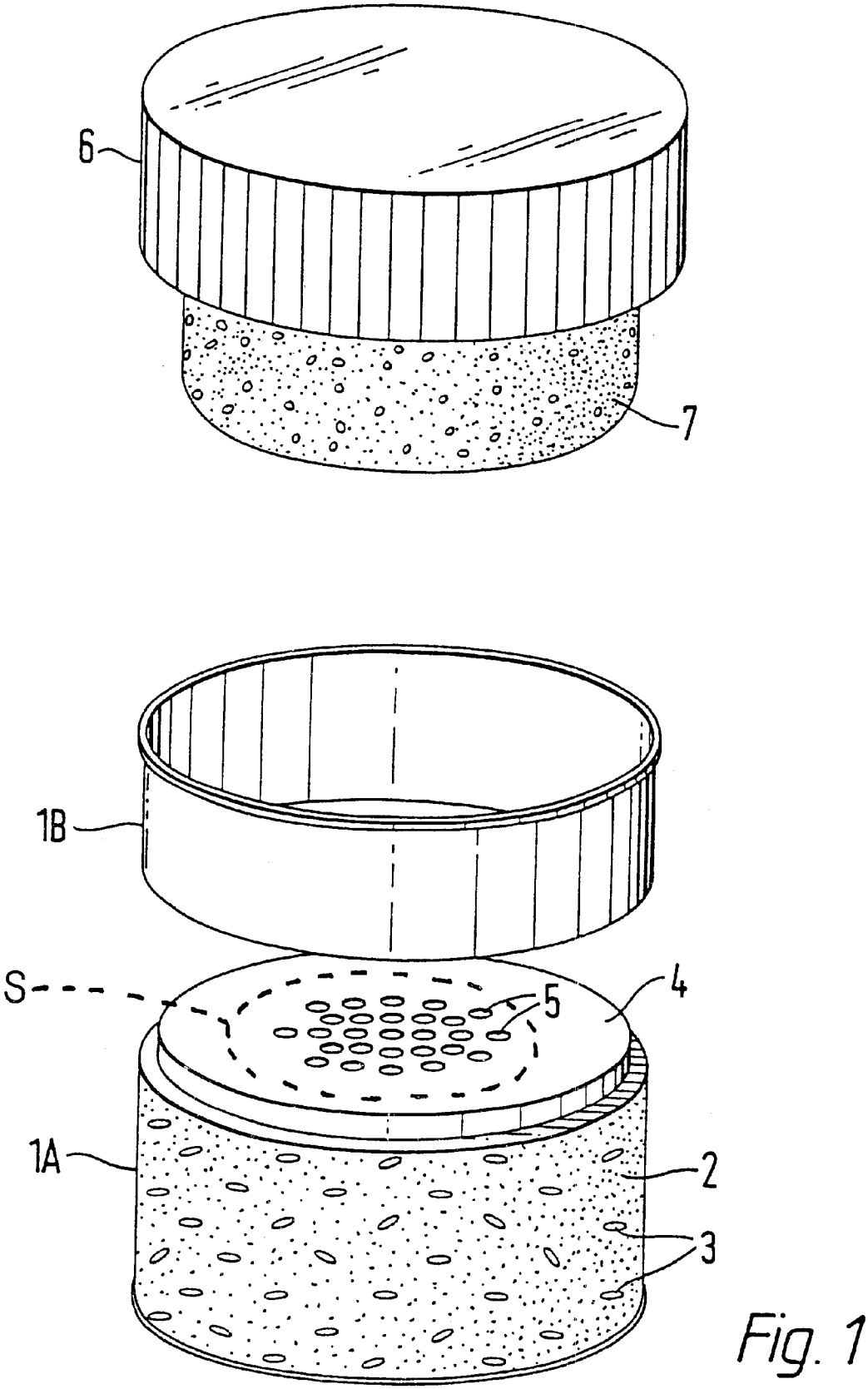
FIG. 1 is a perspective, exploded view of a first embodiment of apparatus according to the invention.

FIG. 1 shows apparatus comprising a container in the form of a plastics or metal can of a size suitable for holding in the hand, e.g. around 10 cm in diameter and 10 cm tall. The can is formed in two parts, a lower reservoir part 1A and an upper cylindrical part 1B. The two parts may be secured together by a push fit, screw threads or other suitable attachment means. A dry powder 2, e.g. a black, non-toxic, water-based powder paint, is held in the reservoir part 1A and a drying agent, for instance rice 3, is preferably mixed with the powder 2 to help keep it dry. A perforated plastics or metal plate 4 is fitted to the upper end of the reservoir part 1A, The perforations 5 in the plate 4 are large enough to allow the powder 2 to pass therethrough, but small enough to prevent the passage of the drying agent 3 through the plate 4. The perforations would typically have dimensions of around 1–2 mm. The drying agent may also be contained in a sachet or other enclosure as well known in other fields. The perforations may be of any suitable shape and arranged in any suitable pattern. The plate 4 may be removable from the reservoir part 1A or may be permanently secured thereto.

The container 1 is provided with closure means in the form of a handle or lid 6 which has applicator means in the form of a synthetic sponge 7 attached to the underside thereof. The applicator sponge 7 is sized so that it fits within the top of the upper container part 1B when the lid 6 is fitted onto the container part 1B.

In use, the container is shaken or inverted with the lid 6 in place so that powdered paint 2 passes through the plate 4 onto the sponge 7. The lid 6 can then be removed and held in the hand to apply the powdered paint adhering to or impregnated in the sponge 7 to the surface on which the guide coat is to be formed. The powder is then distributed over the surface by simply wiping the sponge 7 over the surface to leave a thin coating of dry powder thereon which acts as a guide coat in a similar manner to the conventional form of guide coat described above. The powder is preferably non-film forming when heated, such as, for example, carbon black.

It has been found that the powder remains on relatively rough surfaces such as those of a car body panel being rubbed down (even when it has been rubbed down by a very fine abrasive sheet, e.g. P1200 paper) even whilst the surface is vertical or downward facing but does not remain on or can easily be wiped or blown off a relatively smooth surface such as that of the gloss paint on a car body panel. The powder is removed by subsequent rubbing down techniques, using abrasive blocks, wet and dry sand paper, etc. as described above. The majority of the powder is removed in this way but it has been found that any small amounts of powder remaining after rubbing down can be left in place and are not detrimental to the application of further filler, primers etc. Any powder falling on surrounding paintwork can be simply wiped off with a clean rag, brushed or blown off or removed by washing the surface with water or other suitable solvent.

The perforated plate 4 is preferably provided in the container 1 to help control the quantity of powder applied to the sponge 7 when the container 1 is shaken or inverted. However, it is possible to omit the plate 4 and if excess powder falls onto the sponge 7 this can be shaken off before the sponge 7 is used to apply powder to a surface.

When the reservoir part 1A is charged with powder 2, sticky tape or a sticky label or some other form of seal (shown in phanton in FIG. 1) may be provided over the perforations 5 to prevent powder passing through the plate 4 when the product is being transported or handled before use. The seal is then removed before the apparatus is first used.

The reservoir part 1A may also be supplied on its own as a replacement part for installation in the apparatus when the initial reservoir part 1A has been emptied. Such a "re-fill" may be provided with the perforated plate 4 with the perforations sealed as described above or may be supplied without the plate 4 in which case the container needs to be sealed, e.g. in the same manner as a coffee jar, or sealed by its packaging, e.g. of shrink-wrap plastics material.

The cylindrical part 1B of the container serve to interconnect the reservoir part 1A and the lid 6 and also to provide a space above the plate 4 in which the applicator sponge 7 fits when the lid 6 is fitted to the container.

The reservoir put 1A and the cylindrical part 1B may each be provided with mutually engaging locating means such that only a reservoir part 1A having the appropriate locating means can be fitted to the cylindrical part 1B.

The applicator sponge 7 preferably comprises a compressible medium density synthetic foam material which is capable of absorbing sufficient powder but which is sufficiently firm to enable the powder to be applied to a surface by wiping the sponge 7 over the surface. One form of material which has been found to be suitable is a foam sponge supplied by Motofax Ltd. Under the designation Foam Mator Ester 280 Blue. The sponge 7 would typically have a diameter of around 8 cm and project around 4 cm from the lid 6. The sponge 7 may be simply affixed to the lid 6 by means of an adhesive. Alternatively, the sponge 7 may be removably attached to the lid 6 so it can be replaced if it becomes worn.

Other forms of applicator means may be used, e.g. a synthetic foam, an absorbent cloth or wad of material (such as natural or man-made lambswool) or a soft brush, the man requirement being that the applicator means is capable of absorbing or becoming impregnated with a sufficient quantity of powder which can then be distributed over a surface by wiping the applicator means over the surface.

The lid 6 is preferably provided with ribs or other gripping means around its periphery so that it can be held comfortably in the hand when the sponge 7 is used to apply the powder to a surface. Alternatively, or additionally, the lid may be provided with a strap or band which in use passes around the back of the operator's hand and helps hold the lid and applicator in place in the opeator's hand. In another arrangement, a handle, e.g. in the form of a paint brush handle, may be attached to the applicator.

As mentioned above, the lid 6 and sponge 7 may be separate parts which are secured together. It would also be possible for the applicator means and the closure means to be formed by one item, e.g. by a relatively firm sponge which is shaped to be a push fit within the open end of the container 1 and thus act as closure means.

In another arrangement, the closure means and applicator means may be separate items, for example the closure means may comprise a simple lid and the applicator means comprise a separate sponge which can be stored outside the container or, preferably, within the container.

Any finely divided particulate material or medium may be used to form the guide coat as long as it can be easily distributed over the surface to be smoothed and has the tendency to remain on and thus highlight irregularities on the surface. A powder such as a non-toxic, water soluble black powder paint obtained from the Early Learning Centre (South Marston, Swindon SN3 4TJ, UK) has been found to be suitable. The particulate material may be of any appropriate colour depending on the application. A black guide coat is usually used in the repair of car body panels as this shows up well on light coloured filer materials and on grey primers and undercoats. The material used should preferably be non-staining to paint finishes such as those used on vehicle bodywork. Powder paints for use by children have to meet strict health and safety requirements and are thus believed to be made of natural or inert materials which are unlikely to cause harm if ingested. Materials used in such paints include dried albumen and chalk. Black paints include carbon black and other colours are obtained by the use of natural colouring agents as used in the food industry.

The lid 6 is preferably a tight press-fit onto the container 1 so as to prevent leakage of powder when the lid 6 is in place. Alternatively, a screw-fitting or snap-fit lid may be used.

Figure 2:
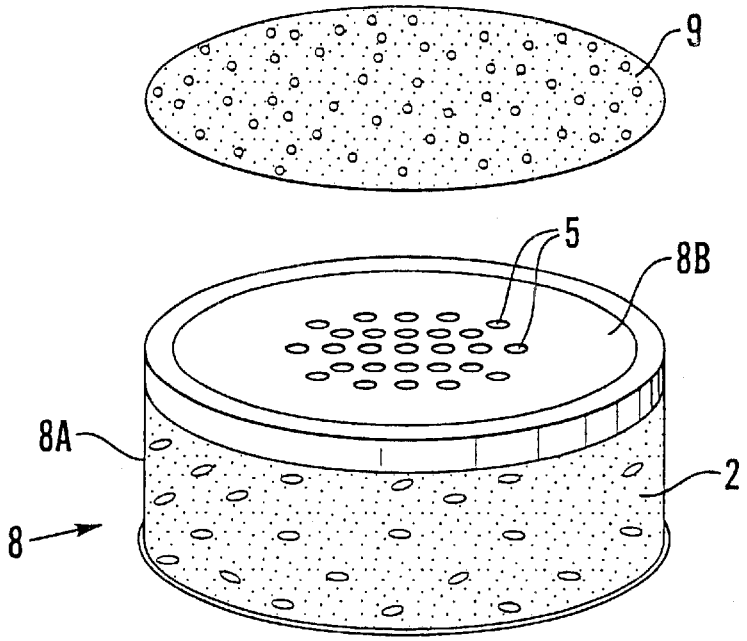
FIG. 2 is a perspective view of a second embodiment of apparatus according to the invention.

FIG. 2 illustrates apparatus comprising just a powder reservoir 8 and an applicator sponge 9. The powder reservoir comprises a container 8A for holding powder and a perforated plate 8B provided at the mouth of the container 8A. The perforated plate 8B may be removable from the container 8A or may be affixed thereto. It will be appreciated that the powder reservoir a and applicator sponge 9 may be supplied together or separately as replacement parts in a similar manner to the corresponding parts described above in relation to FIG. 1.

Figure 3:
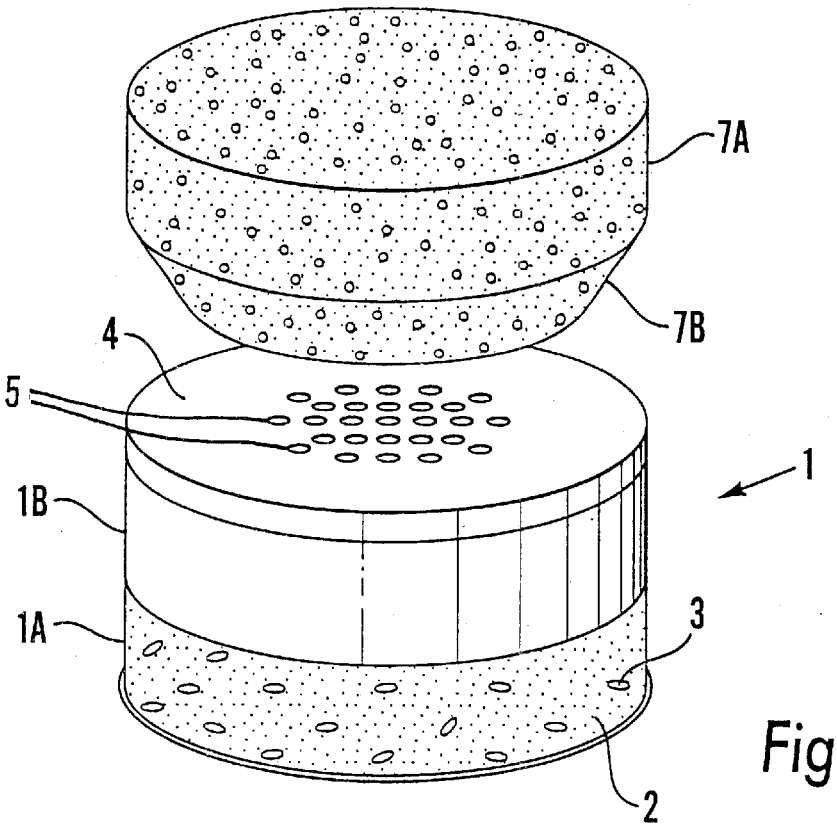
FIG. 3 is a perspective view of a third embodiment of apparatus according to the invention.

FIG. 3 shows another form of the apparatus. This comprises a two-part container 1, the lower part 1A of which holds the powder 2 and the upper part 15 of which carries the perforated plate 4. The two parts 1A and 1B are arranged to fit together e.g. by means of a push-fit, screw threads or other suitable attachment means. The plate 4 is preferably mounted at the upper end of the upper part 1B or it may be positioned within the upper part 1B.

The applicator sponge shown in FIG. 3 has a cylindrical portion 7A for holding in the hand and a shaped portion 7B for applying the powder 2 to a surface. Again, the applicator sponge may be provided separately as a replacement part.

Additional powder can be supplied either in a container which replaces the lower part 1A described above or both the lower part 1A and the upper part 1B may be supplied together as a replacement part. If the plate 4 is removable from the upper part 1B, it may also be supplied separately. Otherwise, if a new plate 4 is required it may be supplied installed in a replacement upper part 1B.

In each of the embodiments described, it will be appreciated that it would also be possible to provide additional powder in a sachet, bag or some other enclosure for re-charging the powder reservoir once this has been emptied. This would obviously be most easily done in those embodiments in which the perforated plate or a component housing the perforated plate 4 is removable from the container to be re-charged with powder.

It will be appreciated that the apparatus described above, although of simple construction, provide: an easy and effective way of applying a guide coat to a surface. The method of forming a guide coat described also has many advantages over conventional methods: masking of surrounding paint work is not required, it uses more environmentally safe materials which are not combustible or volatile, no special storage conditions are required and the powder has a long shelf-life, and, if a dry powder is used, no drying time is required once the guide coat has been applied.

The apparatus described above comprises various components: a lid and sponge of the type shown in FIG. 1, upper and lower parts of a container of the type shown in FIG. 1, applicator sponges of the types shown in FIGS. 2 and 3, a powder reservoir as shown in FIG. 2, a removable perforated plate 4, and an upper container part 1B and a lower container part 1A as shown in FIG. 3. It will be appreciated that not only may these various parts be supplied separately as replacement parts of "re-fills", but the parts may also be combined in other combinations besides those illustrated in the drawings. As described above, the interconnecting parts are preferably provided with mutually engageable locating means such that only parts having the appropriate locating means can be securely fitted together.

INDUSTRIAL APPLICABILITY

The apparatus and method described can be used in a wide variety of applications such as the rubbing down of layers of filler or primer or undercoats of paint used in the repair of a car body panel as described above including both dry flatting processes and wet and dry processes. It may also be used for forming a guide coat in the rubbing down or machining of other surfaces whether of metal, wood, glass or other material.

What is claimed is:

1. A guide coat forming apparatus, comprising:

a first container part;

material for distributing over a surface of a vehicle body as a guide coat located in the first container part, the material being held in a substantially loose, finely divided particulate form, wherein the particulate material comprises at least carbon black;

an applicator for application of a guide coat on a vehicle body as part of a smoothing or refinishing operation;

a second container part for receiving the applicator on which the particulate material is to be sprinkled or shaken; and a perforated member located between the first and second container parts through which the particulate material can be sprinkled or shaken.

2. A guide coat forming apparatus, comprising:

a first container part;

material for distributing over a surface of a vehicle body as a guide coat located in the first container part, the material being held in a substantially loose, finely divided particulate form, wherein the particulate material comprises a plurality of components, at least one of which is carbon black or albumen or chalk;

an applicator for application of a guide coat on a vehicle body as part of a smoothing or refinishing operation;

a second container part for receiving the applicator on which the particulate material is to be sprinkled or shaken; and a perforated member located between the first and second container parts through which the particulate material can be sprinkled or shaken.

3. A guide coat forming apparatus, comprising:

a container having a first container part;

guide coat forming material located in the first container part and capable of highlighting irregularities in a vehicle surface, the guide coat forming material being a substantially loose, finely divided particulate material that comprises a plurality of components, at least one of which is carbon black or dried albumen or chalk;

a perforated member connected to the first container part and having perforations through which the guide coat forming material can pass;

a second container part having an upstanding wall and forming a space adjacent the perforated member; and an applicator having a handle with a sponge attached to the handle, the sponge shaped to fit into the space formed by the second container part.

4. A guide coat forming apparatus as claimed in claim 3, wherein the sponge is removably attached to the handle.

* * * * *